US005689762A

United States Patent [19]

Hamaguchi

[11] Patent Number: 5,689,762

[45] Date of Patent: Nov. 18, 1997

[54] IMAGE FORMING APPARATUS EQUIPPED WITH IMAGE QUALITY AND ADJUSTING DEVICE

[75] Inventor: Kazuya Hamaguchi, Nara, Japan

[73] Assignee: Sharp Kabushiki Kaisha, Osaka, Japan

[21] Appl. No.: 587,539

[22] Filed: Jan. 17, 1996

[30] Foreign Application Priority Data

Feb. 13, 1995 [JP] Japan ..... 7-024013

[51] Int. Cl.[6] ..... G03G 15/043

[52] U.S. Cl. ..... 399/51

[58] Field of Search ..... 399/47, 51, 177, 399/38, 46, 49, 52

[56] References Cited

U.S. PATENT DOCUMENTS 4,965,634 10/1990 Bando ..... 399/49

4,982,232 1/1991 Naito ..... 399/51

*Primary Examiner*—S. Lee

*Attorney, Agent, or Firm*—David G. Conlin; William J. Daley, Jr.; Peter F. Corless

[57] ABSTRACT

A reflected-light amount detecting process is performed for white-standard and halftone-standard originals, respectively. Based on the analysis of resulting images, correct exposure voltages Vcl(WH) and Vcl(HT) are determined. When the thus determined voltage is applied to a copy lamp to turn it on, an AE sensor, receiving the light reflected from a corresponding original of the white-standard and halftone-standard originals, and outputs a corresponding output current Vae(WH) or Vae(HT). These output currents detected are used in combination with the correct exposure voltages Vcl(WH) and Vcl(HT), to calculate control constants for determining a control characteristic.

4 Claims, 9 Drawing Sheets

IMAGE FORMING APPARATUS EQUIPPED WITH IMAGE QUALITY AND ADJUSTING DEVICE

BACKGROUND OF THE INVENTION (1) Field of the Invention

The present invention relates to an image forming apparatus such as copiers, and particularly relates to an image forming apparatus wherein the light amount of an exposure light source for illuminating an original is controlled in response with the density of the original.

(2) Description of the Prior Art

In the conventional copiers, there is a problem as to a relation between the density of the original and the amount of light for exposure. That is, when a whitish original with patterns, characters drawn with minute lines and the like is to be copied; if the original is scanned by an exposure light source with an increased amount of light, the minute lines vanishes in the resulting image. On the other hand, when an original having medium gradations in its background is to be copied; if the amount of light of the copy lamp is reduced, the back ground becomes black in the resulting image. In order to solve this problem, some copiers having an automatic exposure controlling function have been proposed in which density of the original is detected and based on the detected density, the amount of light of the copy lamp is automatically controlled. A typical example of such copiers having the automatic exposure control function copier (image forming apparatus) is disclosed in Japanese Patent Application Laid-Open Sho 60 No. 10,269. In this copier, an AE sensor having a photodiode and the like receives the reflected light from the original and outputs a current corresponding to the amount of light received. This current is used as a reference to control the voltage to be applied to the copy lamp.

In the conventional copiers, a control characteristic which relates the obtained currents from the AE sensor to the voltages applied to the copy lamp should be previously set up and the voltage applied to the copy lamp should be controlled based on the control characteristic. In this case, the identical characteristic was used for all the copier of the same make. However, each AE sensor has an individual aberration, that is, the output current from an AE sensor to a specified amount of input light differs that from another AE sensor to the same input light. Besides, as to the copy lamp, the amount of emitting light to an applied voltage varies depending on each product. Further, there is some dispersion of ICs for OP amps. etc., or dispersion due to the assembly of the mechanism for the optical system and the like. Therefore, in order to obtain a satisfied reproduction image, it is necessary to determine an individual control characteristic for each copier and set up the thus obtained control characteristic. However, this operation requires time and labor, so that there has been a problem that the cost of a copier is increased.

Further, due to the degradation of the AE sensor as it is used or with the passage of time, the relation of the output current to the amount of input light varies. Accordingly, in order to constantly obtain a satisfied reproduction image for any original having different densities, the control characteristic should be corrected in accordance with the used status of the copier.

SUMMARY OF THE INVENTION

It is therefore an object of the invention to provide an image forming apparatus which automatically calculates a control characteristic for determining the amount of emitted light from an exposure light source in association with the density level of an original image and wherein the control characteristic is modified in accordance with the usage status. The present invention has been achieved in order to attain the above object and the gist of the invention is as follows:

Initially, in accordance with a first feature of the invention, an image forming apparatus includes: a plurality of density samples having different levels of density; an exposure light source for exposing an original and the density samples to light; a reflected-light amount detecting means for detecting the amounts of light reflected from the density samples, each of which is exposed to a respective predetermined exposure amount of light; a control-characteristic calculating means for calculating a control characteristic for determining an exposure light amount corresponding to a reflected-light amount, based on the amounts of light reflected from the density samples; and an exposure light amount controlling means for controlling the amount of light emitted from the exposure light source to the original, based on the control characteristic.

In accordance with a second feature of the invention, an image forming apparatus defined in the first feature of the invention, is constructed such that when one of previously setup conditions holds such as when a predetermined time has passed, when a predetermined number of exposures for originals have been made or when the apparatus is activated, the procedures in the reflected-light amount detecting means and the control-characteristic calculating means are effected again.

In accordance with third and fourth features of the invention, an image forming apparatus defined in the first or second feature of the invention, further includes: an average-value calculating means for calculating an average of the latest several times of detection of reflected-light amount for each density sample, and is constructed such that the reflected-light amount detecting means includes an error-treatment processing means which compares a current detected value of the reflected-light amount for each density sample with the average value for the same density sample and which determines the last detection as to be an error if the difference between the current detected value of the reflected-light amount and the average value is greater than a predetermined value.

In the image forming apparatus of the invention, when each density sample is exposed to a predetermined amount of exposure light for the sample, the reflected-light amount is detected. Based on the detection, a control characteristic which determines an exposure light amount in association with an amount of reflected light is calculated. During copying, the amount of light reflected from an illuminated original is detected to control the amount of exposure light for the original, based on the aforementioned control characteristic. That is, the image forming apparatus automatically calculates its control characteristic, so that it is possible to set up a control characteristic without increasing the cost.

When one of previously setup conditions holds such as when a predetermined time has passed, when a predetermined number of exposures for originals have been made or when the apparatus is activated, the procedures in the reflected-light amount detecting means and the control-characteristic calculating means are effected again. In this way, if the conditions for modifying the control characteristic are set up, it is possible to update or modify the control characteristic every time one of the conditions is satisfied.

Accordingly, it is possible to constantly obtain satisfied duplications of images.

In the invention, the amount of reflected light detected for each of the density samples is compared with the average of reflected-light amounts detected at the latest some or several times of detection for each density sample. Based on the comparison, if there is a difference of greater than a prescribed value, the last detection is determined as to be an error and the system effects an associated treatment with that. As a result, if there occurs mis-detection of the reflected-light amount, the system will not set up an inappropriate control characteristic.

DESCRIPTION OF THE PREFERRED EMBODIMENTS

An embodiment of the invention will hereinafter be described in detail with reference to the accompanying drawings.

Figure 1:
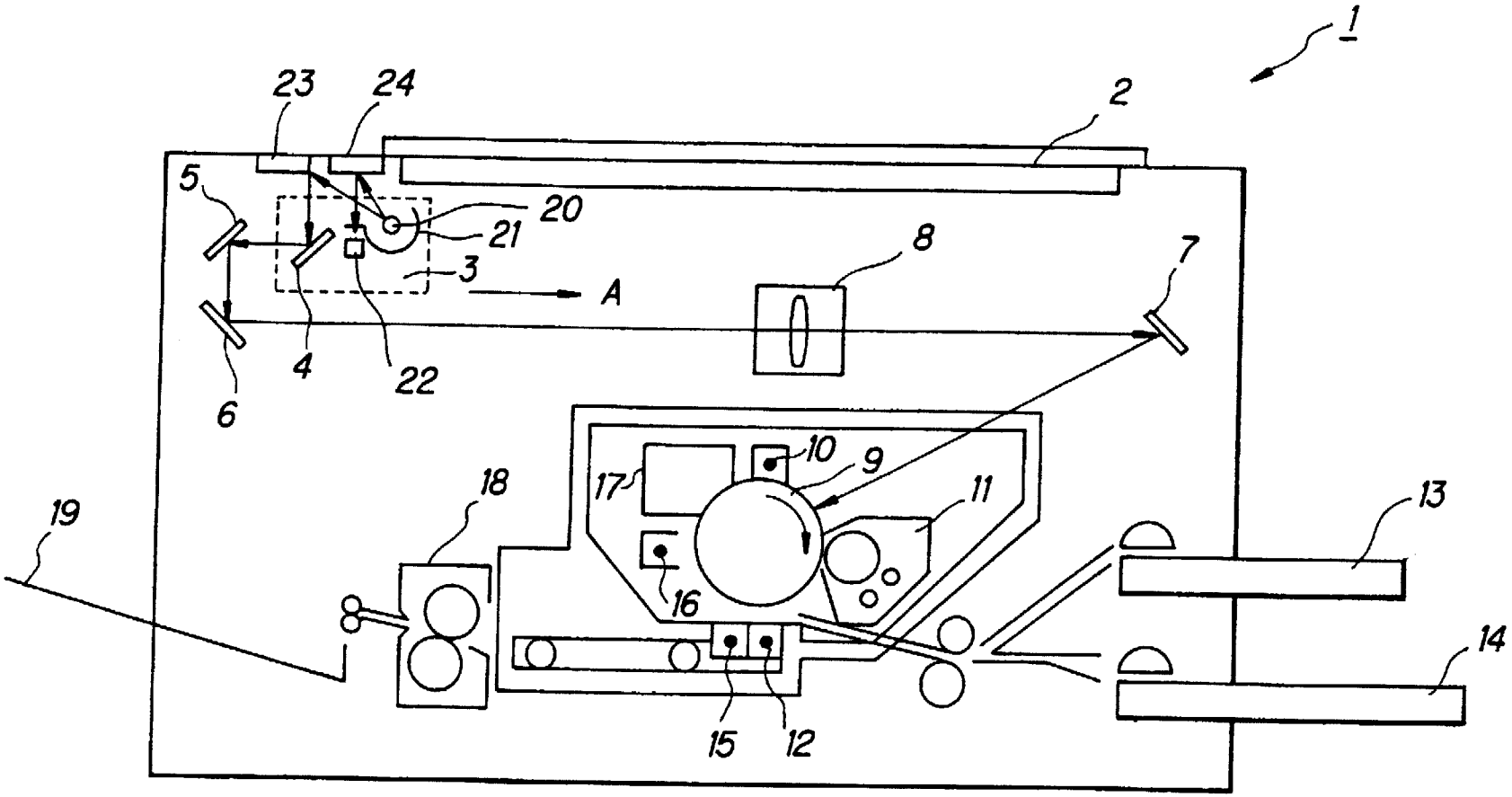
FIG. 1 is view showing a configuration of a copier as an embodiment of the invention.

FIG. 1 is a view showing a configuration of a copier in accordance with an embodiment of the invention. The copier designated at 1 includes: an optical system for scanning an original placed on an original table 2; an image forming portion for forming a toner image of the original and transferring the image onto a copy sheet; a paper feed portion for setting copy sheets; a fixing portion for fixing the transferred toner image to the copy sheet; and a paper discharging portion for discharging the sheet with the original image transferred thereon. The optical system includes: an exposure unit 3 consisting of a copy lamp 20, a reflector 21, an AE sensor 22, and mirror 4; and mirrors 5, 6 and 7 and a lens 8 for guiding the reflected light from the original to the image forming portion. The image forming portion has a photoreceptor drum 9 which rotates clockwise. Provided around the photoreceptor drum 9 are a main charger 10, a developing unit 11, a transfer charger 12, and a separation charger 15, an charge-erasing charger 16, a cleaner 17, arranged in that order. Placed in the paper feeding portion are sheet cassettes 13 and 14 which accommodate copy sheets. The fixing portion is composed of a fixer 18 while the paper discharge portion is provided with a copy output tray 19.

In the copier 1, a pair of density samples 23, 24 provided within the scan area of the exposure unit 3 and outside where the original is to be placed. The two samples are arranged side by side on the home-position side of the exposure unit 3, in the scan direction (in the direction of an arrow A in the figure) of the exposure unit 3. The density sample 23 is white in its surface, whereas the density sample 24 is of a medium tone (gray) on its surface. In this embodiment, a density valued at 0.06 in the reflection density meter (Macbeth density meter) is defined as 'white' and a density valued at 0.3 is used as 'gray'. This standard is used for image a typical adjustment for copiers.

In copying, the exposure unit 3, as traveling in the direction of arrow A in FIG. 1, scans the original placed on the original table 2. Reflected light from the original, after passing through the mirrors 4, 5, 6, 7 and the lens 8, reaches the photoreceptor drum 9. The photoreceptor drum 9 is charged by the main charger 10 and receives the reflected light from the original so that an electrostatic latent image of the original image is formed on the surface of the drum. In the developing unit 11, the static latent image is developed into a toner image. This toner image is transferred by the transfer charger 12 to a copy sheet which is delivered from the paper feed cassette 13 or 14 disposed in the paper feed portion. The copy sheet with the toner image transferred thereon is separated from the photoreceptor drum 9 with the help of the separation charger 15 and delivered to the fixing unit 18. Then, residual charges on the photoreceptor drum 9 are erased by the charge-erasing charger 16, thereafter remaining toner on the surface is cleaned by the cleaner 17. Then, the drum 9 is charged by the main charger 10 and the same process is repeated. The sheet conveyed to the fixing unit 18, having the toner image fixed thereon, is discharged to the copy output tray 19. During the copying operation, the amount of emitted light from the copy lamp 20 is controlled in response to the original density, based on the aftermentioned control characteristic predeterminedly set up. The control on the amount of emitted light from the copy lamp 20 will also be described later.

Figure 2:
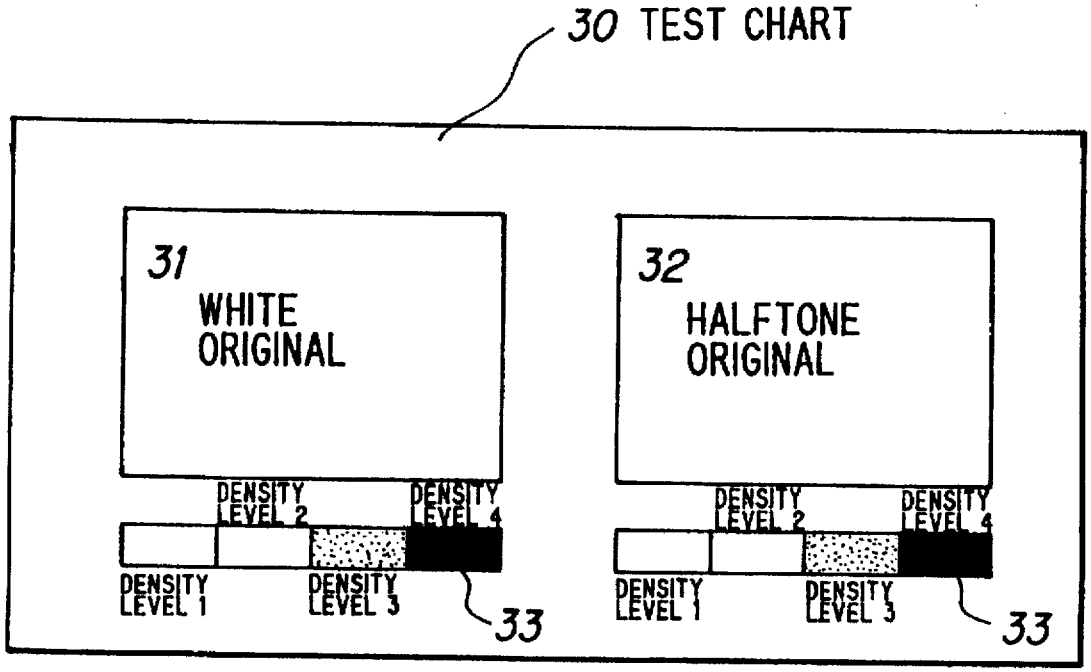
FIG. 2 is a view showing a test chart.

In the copier, appropriate exposure values for a white original (having a density value of 0.06 in the reflection density meter) and for a halftone original (having a density value of 0.3 in the reflection density meter) are set up by the process as follows. FIG. 2 is a view showing a test chart 30 to be used when these exposure values are set up. This test chart 30 is generally used for typical image-adjustment in the image forming apparatuses such as copiers etc., and has a white original 31 and a halftone original (gray original) 32 applied together thereto. Gray-scales 33 are attached under the white original 31 and the halftone original 32, respectively. The gray scale 33 has four levels of density which become dark from levels 1 to 4.

Initially, the test chart 30 is set on the original table 2 so that the levels of density of the gray scales 33 vary along the scan direction while the mode of the copier is changed over into a mode (simulation mode) for image-adjustment of the copier. The changeover into the simulation mode is performed by a predetermined key operation on an unillustrated control panel in the copier. In the simulation mode, a sub-mode (white-original mode) for adjusting the appropriate exposure voltage for the white original is selected and a voltage (which is assumed to give a standard exposure to the white original) to be applied to the copy lamp 20 is set up, and the copy operation is started. In this operation, the voltage to be applied to the copy lamp 20 may have been set up previously. The copier is made to operate a copy process with the thus set up voltage applied to the copy lamp 20. The applied voltage to the copy lamp 20 is kept constant at the designated level, without being varied during the copying operation. When the copying operation is complete, a pattern of the gray scale 33 is reproduced on the sheet. The reproduced image of the gray scale 33 varies, that is, become whitish or darkish and foggy depending upon the voltage (or the amount of light exposure to the original) applied to the copy lamp 20. Referring specifically to the gray scale 33 used in this embodiment, if the white original is copied in a correct exposure, the portion at density level 1 will completely vanish (become white) and the portion at density level 2 will be reproduced as a slightly dark and foggy image.

In this situation, the copied gray scale 33 reproduced on the sheet should be observed and checked. If the gray scale 33 is copied so that the portion at density level 1 is reproduced slightly dark and foggy and the portion at density level 2 is reproduced clearly dark and foggy, this indicates that the copy is done with a smaller exposure light amount than the necessary light amount. On the other hand, when the gray scale 33 is reproduced so that the portions at density levels 1 and 2 are both reproduced as to be completely white, this indicates that the copy is done with a greater exposure light amount than the necessary light amount. When the copy is made darker, the setup voltage applied to the copy lamp 20 should be increased a bit, whereas the setup voltage to the copy lamp 20 should be decreased a bit if the copy is made lighter. After the adjustment, the copying operation should be done again. This operation should be repeated until the portion at density level 1 of the gray scale 33 is reproduced as complete white while the portion at density level 2 is reproduced as to be slightly dark and foggy. When this condition is satisfied, the voltage applied to the copy lamp 20 at that condition is determined and set up as to be the correct exposure voltage (Vcl(WH) [V]) for the white original.

Next, in the simulation mode, another sub-mode (halftone-original mode) for adjusting the appropriate exposure voltage for the halftone original is selected and a voltage (which is assumed to give a standard exposure to the halftone original) to be applied to the copy lamp 20 is set up, and the copy operation is started. Here, similarly as above, the voltage to be applied to the copy lamp 20 may be set up previously. The copier is made to operate a copy process with the thus set up voltage applied to the copy lamp 20. Also during the copying operation, the applied voltage to the copy lamp 20 is kept constant at the designated level, without being varied. After the copying operation is completed, the copied gray scale 33 reproduced on the sheet should be observed and checked.

In this case, as to the gray scale 33 used in this embodiment, if the halftone original is copied in a correct exposure, the portion at density level 3 completely vanishes (becomes white) and the portion at density level 4 is reproduced as a slightly dark and foggy image. If the gray scale 33 is copied so that the portion at density level 3 is reproduced slightly dark foggy and the portion at density level 4 is reproduced clearly dark and foggy, this indicates that the copy is done with a smaller exposure light amount than the necessary light amount. When the gray scale 33 is reproduced so that the portions at density levels 3 and 4 are both reproduced as to be completely white, this indicates that the copy is done with a greater exposure light amount than the necessary light amount. When the copy is made darker, the setup voltage applied to the copy lamp 20 should be increased a bit, whereas the setup voltage to the copy lamp 20 should be decreased a bit if the copy is made lighter. After the adjustment, the copying operation should be done again. This operation should be repeated until the portion at density level 3 is reproduced as complete white while the portion at density level 4 is reproduced as to be slightly dark and foggy. When this condition is satisfied, the voltage applied to the copy lamp 20 at that condition is determined and set up as to be the correct exposure voltage (Vcl(HT) [V]) for the halftone original.

Figure 3:
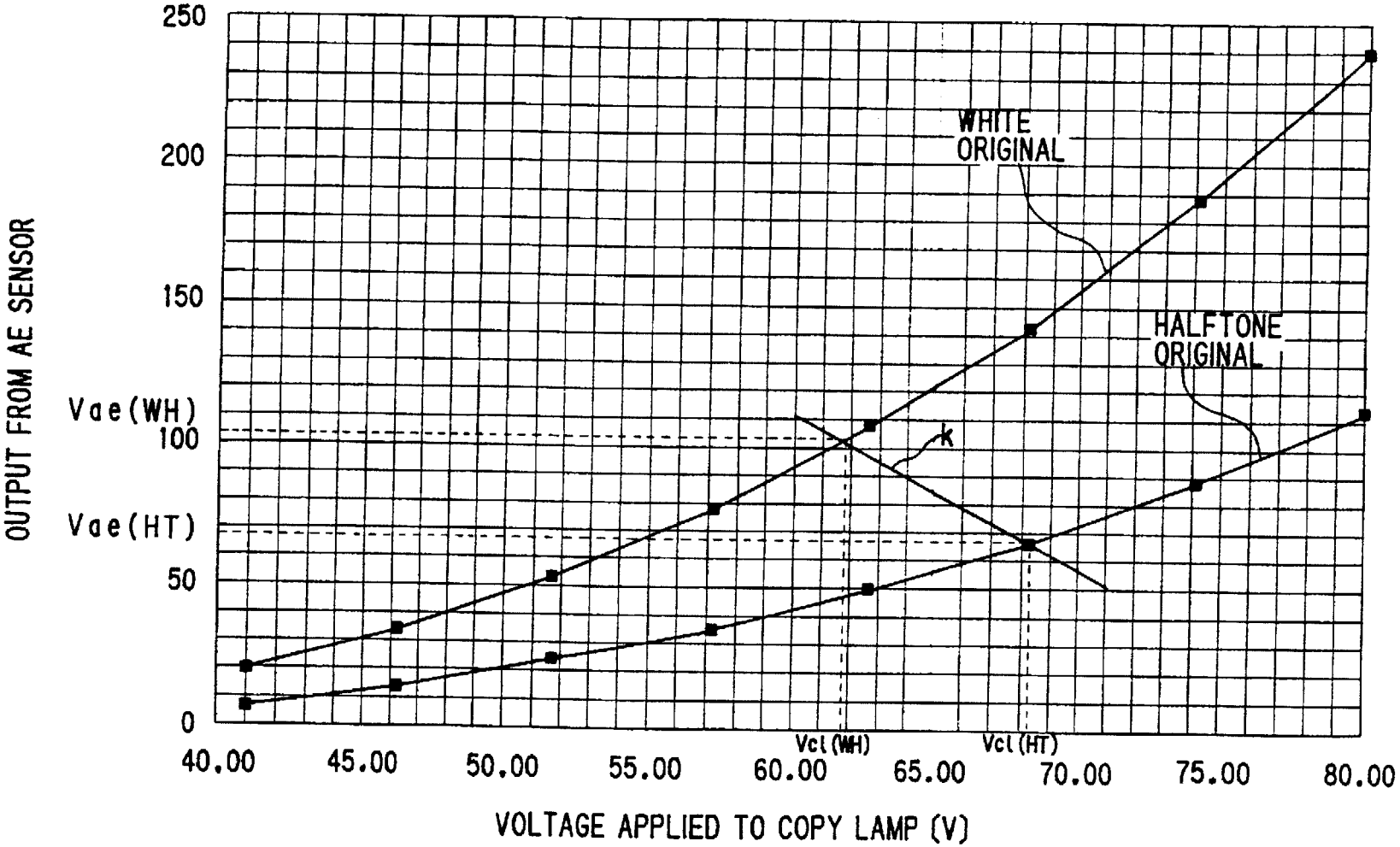
FIG. 3 is a graph showing relations between the voltages applied to a copy lamp and the output currents from an AE sensor.

In this way, the correct exposure voltage (Vcl(WH) [V]) allowing the white original to be reproduced in the correct exposure and the correct exposure voltage (Vcl(HT) [V]) allowing the halftone original to be reproduced in the correct exposure are set up. FIG. 3 is a graph showing relations between the voltages applied to the copy lamp 20 for the white and halftone originals and the output currents from the AE sensor 22. In this graph, the correct exposure voltage (Vcl(WH) [V]) for the white original and the correct exposure voltage (Vcl(HT) [V]) for the halftone original, both obtained in the above process, are depicted. The correct exposure voltage (Vcl(WH) [V]) for the white original is low as compared to the correct exposure voltage (Vcl(HT) [V]) for the halftone original. As the voltage to be applied to the copy lamp 20 is increased (or the amount of exposure is increased), the output current from the AE sensor 22 increases. Although in the above description, the conventionally used typical test chart 30 having the white original 31 and the halftone original 32 applied thereon was used in adjusting the quality of image in the image forming apparatus, the above operation can be done using a test chart containing at least one gray scale 33. In the above description, the gray scale 33 used was of four levels, but the present invention should not be limited to this configuration. A gray scale having five or six levels of density may be used.

As the correct exposure voltage (Vcl(WH) [V]) for the white original and the correct exposure voltage (Vcl(HT) [V]) for the halftone original have been set up in the above procedure, a process for determining a control characteristic which will be used when an automatic exposure control is performed is operated. This process is activated by a predetermined key operation through the control panel. When the key operation to activate the process for determining a control characteristic is made, a reflected-light amount detecting means of the invention will be operated (this operation will be referred to hereinbelow as a first step).

Figure 4:
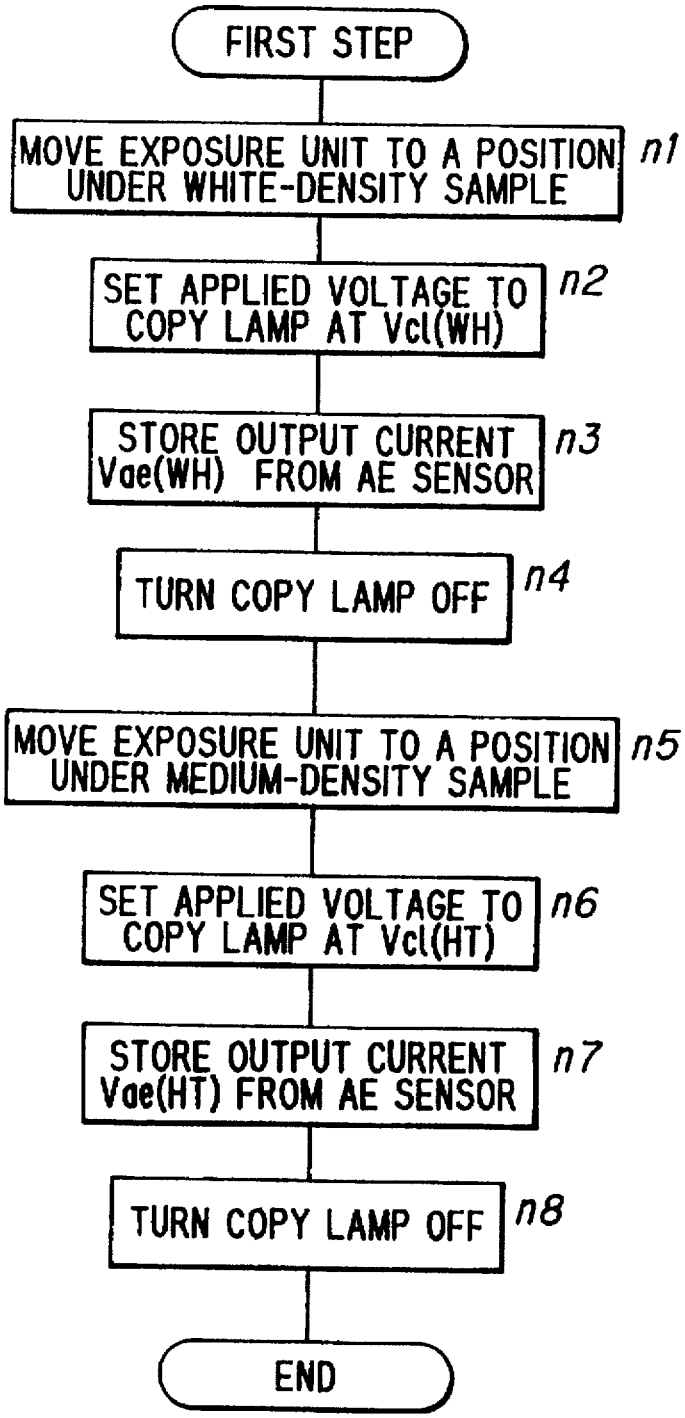
FIG. 4 is a flowchart showing a process of a first step.
Figure 5:
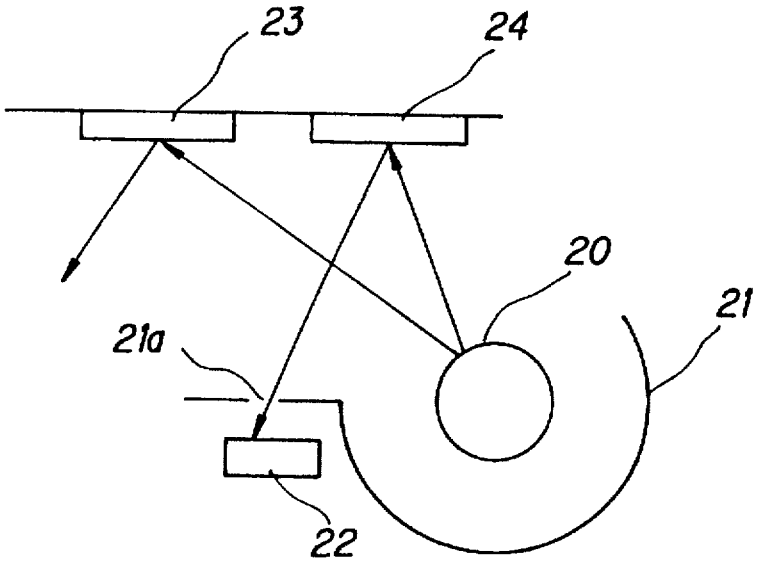
FIG. 5 is a view showing a configuration of an exposure unit.

FIG. 4 is a flowchart showing procedures in the first step. Referring to FIG. 5, a reflector 21 has a slit 21*a* of 2 to 3 mm wide. Light passing through the slit 21*a* is received by the AE sensor 22. First, the copy lamp 20 is moved to a position under the white-density sample 23 and the correct exposure voltage (Vcl(WH) [V]) previously set up for the white original is applied to the copy lamp 20 (n1 and n2). The surface density of the density sample 23 is the same with that of the white original 31 used above. In this configuration, if for example, there is no extension having the slit 21*a*, the AE sensor 22 will receive the reflected light from the sample 23 and light reflected from portions other than the density sample 23, resulting in inability to exactly detect the reflected light only from the density sample 23. This is because the extension part with the slit 21*a* is disposed to thereby control the directivity of the AE sensor 22. That is, in this arrangement, the sensor receives only the reflected light from the density sample 23. The AE sensor 22 outputs a current in accordance with the amount of light received. This current value is stored in the memory as a Vae(WH). Then, the copy lamp 20 is put out (n3 and n4).

Then, the copy lamp 20 is moved to a position under the gray-density sample 24 and the correct exposure voltage (Vcl(HT) [V]) previously set up for the halftone original is applied to the copy lamp 20 (n5 and n6). The surface density of the density sample 24 is the same with that of the halftone original 32 used above. Since the directivity of the AE sensor 22 is controlled by the slit 21*a*, as stated above, the sensor 22 receives reflected light only from the density sample 24 and will not receive (any reflected light from the density sample 23). The AE sensor 22 outputs a current in accordance with the amount of light received. This current value is stored in the memory as a Vae(HT). Then, the copy lamp 20 is put out (n7 and n8).

The above first step is to detect the amounts of reflected light from the white original and the halftone original when the correct exposure voltage Vcl(WH) for the white original and the correct exposure voltage Vcl(HT) for the halftone original are respectively applied to the copy lamp 20. Here, since the directivity of the AE sensor 22 is regulated by the slit 21*a*, the amount of reflected light can exactly be metered.

Figure 6:
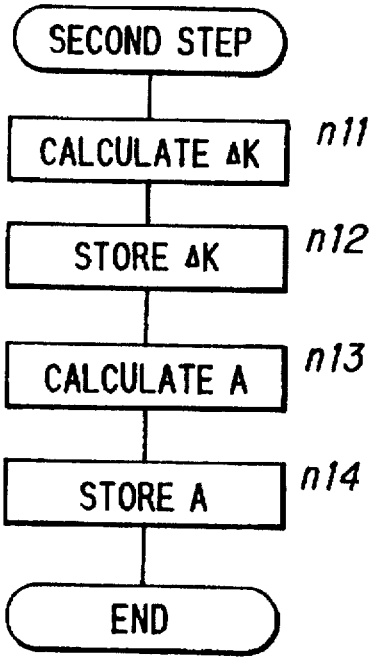
FIG. 6 is a flowchart showing a process of a second step.

Then, a process for effecting calculations based on the above Vae(WH) and Vae(HT) thus obtained (this step will be referred to hereinbelow as a second step) will be carried out to determine a control characteristic (see FIG. 6). There appear two control constants Δk and A which are defined as follows: In the following formula, Δk is calculated and the result is stored in the memory (n11 and n12).

$$\Delta k=\{Vae(WH)-Vae(HT)\}/\{Vcl(HT)-Vcl(WH)\}.$$

Then, A is calculated from the following formula:

$$A=Vcl(HT)\times\Delta k+Vae(WH)$$

These are stored in the memory (n13 and n14).

Figure 7:
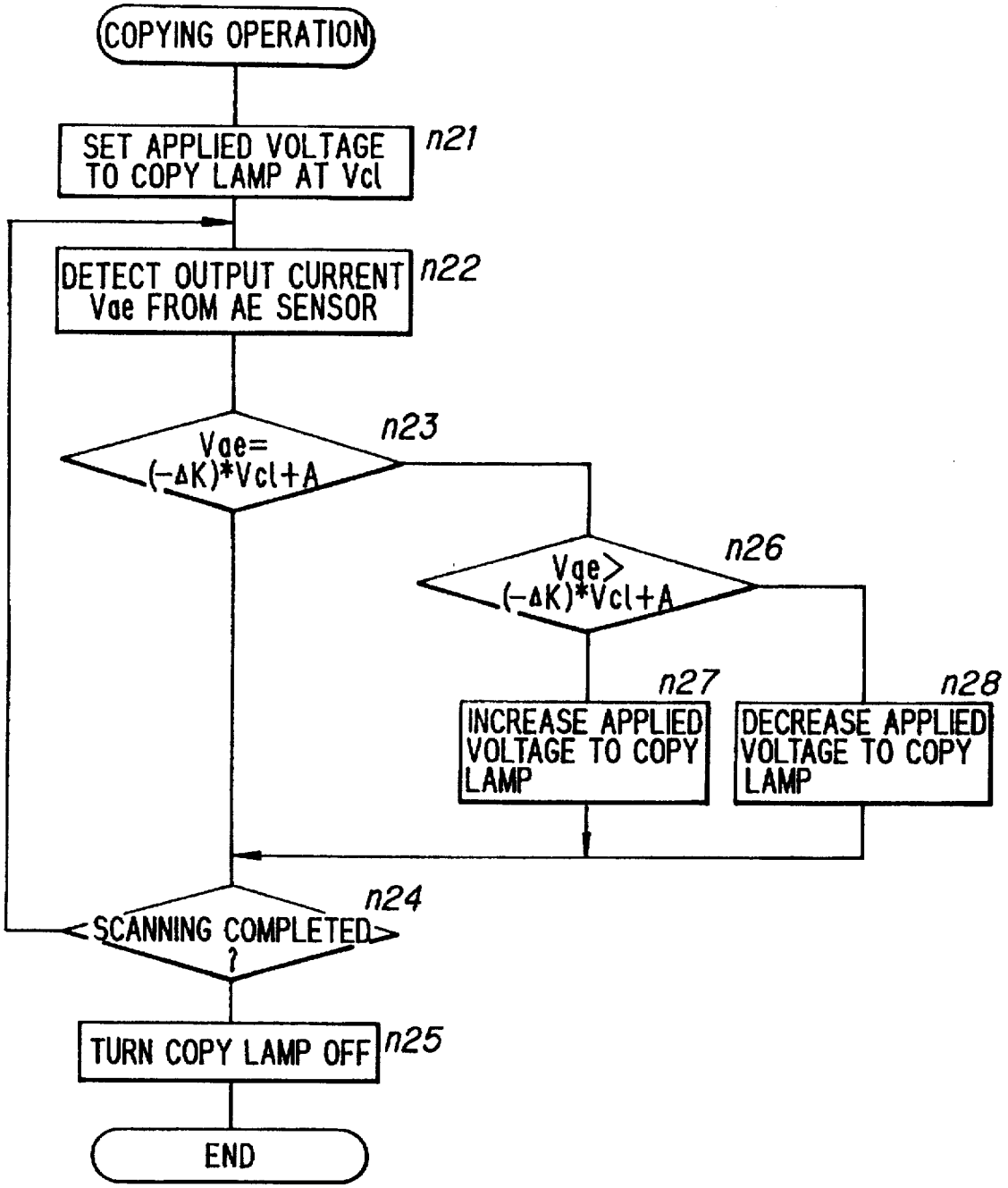
FIG. 7 is a flowchart showing a copying process.

A control characteristic is determined from the thus calculated Δk and A and is used to control the exposure light amount for different levels of density of the original during the copying operation. FIG. 7 is a flowchart showing a process during the copying operation. In this process, the exposure light amount for an original is controlled by varying the applied voltage to the copy lamp 20. As the copy key on the control portion is operated to start a copying operation, the copy lamp 20 is applied with a voltage Vcl to turn on (n21). The exposure unit 3, as traveling in the direction of A shown in FIG. 1, starts scanning of the original. The AE sensor 22 receives reflected light from the original and outputs a current Vae in accordance with the amount of light received (n22). The magnitude of the thus obtained Vae is compared with that of {(−Δk)×Vcl+A}, whereby a judgment is made on whether the exposure at that moment is correct for the original density (n23). In this comparison, if the current Vae is equal to {(−Δk)×Vcl+A}, the exposure light amount at that moment is optimal for the original density. In this case, the scanning of the original is continued without changing the voltage Vcl applied at that moment to the copy lamp 20. If the current Vae is greater than {(−Δk)×Vcl+A}, it is determined that the exposure light amount is excessive for the original density, and the voltage Vcl currently applied to the copy lamp 20 is decreased and the scanning of the original is kept on (n26 and n28). If the current Vae is smaller than {(−Δk)×Vcl+A}, it is determined that the exposure light amount is insufficient for the original density, and the voltage Vcl currently applied to the copy lamp 20 is increased and the scanning of the original is kept on (n26 and n27).

The current (Vae) from AE sensor and the voltage (Vcl) to the copy lamp are controlled so that a point designated by (Vcl, Vae) detected during the copying operation converges toward and becomes laid on a straight line k (shown in FIG. 3) joined between the points (Vcl(WH), Vae(WH)) and (Vcl(HT), Vae(HT)) detected by the aforementioned process. If the detected point (Vcl, Vae) during the copying operation is present on the upper side of the line k, the exposure light amount is excessive for the density of the original. Therefore, the voltage applied to the copy lamp 20 is decreased. On the other hand, if the detected point (Vcl, Vae) during the copying operation is present on the lower side of the line k, the exposure light amount is inadequate for the density of the original. Therefore, the voltage applied to the copy lamp 20 is increased. The control characteristic of the copier is the characteristic indicated by the line k.

The comparison between the magnitudes of Vae and {(−Δk)×Vcl+A} is repeatedly made during the scanning of the original so that the voltage to be applied to the copy lamp 20 is controlled or updated. When the scanning of the original is complete, the copy lamp 20 is turned off to end the copying operation (n24 and n25). For instance, even if the original has certain variations in its density within the original image, it is possible to adjust the amount of emitted light from the copy lamp 20 to the optimal exposure value corresponding to the varying density of the original image. Accordingly, it is possible to obtain a sufficient duplication of an original image even if the density of the original varies within the image area.

Thus, since the control characteristic can be easily set up for each copier, it is possible to effect automatic exposure control in association with an individual copier, without being affected by the dispersion of the amount of emitted light from the copy lamp 20 or by the dispersion of the sensitivity of the AE sensor 22 or any other fluctuation factors. Since the control characteristic can be easily set up without needing manual operation, there no more occurs the problem of cost increase. Since the density sample 23 of the white tone and the density sample 24 of the halftone are used as the standards, it is possible to exactly control the amount of exposure light for typical originals demanded to be copied most frequently (originals having tones of white tone to medium tone).

Next, a modifying operation of the control characteristic will be described. Even if the AE sensor 22 receives the same amount of light, the output current from the AE sensor 22 could vary due to the degradation with the usage or with the passage of time. Accordingly, it is impossible to obtain stable duplications of images all the time if the copying operation is effected without the variations modified. In this embodiment, the copier is constructed such that, when one of previously setup conditions holds such as when the copier is activated, when a predetermined time has passed, or when a predetermined number of copies have been made, the modifying operation of the control characteristic will be made by effecting the above first and second steps. In this case, if a copying operation is being effected when the predetermined time has passed or the predetermined number of copies have been made, the modifying operation should be done after the completion of the copying operation. Therefore, the modifying operation will not cut into the operation while an user is using the copier for making copies. That is, there is no fear that the copying operation of the user would be interrupted.

Figure 8:
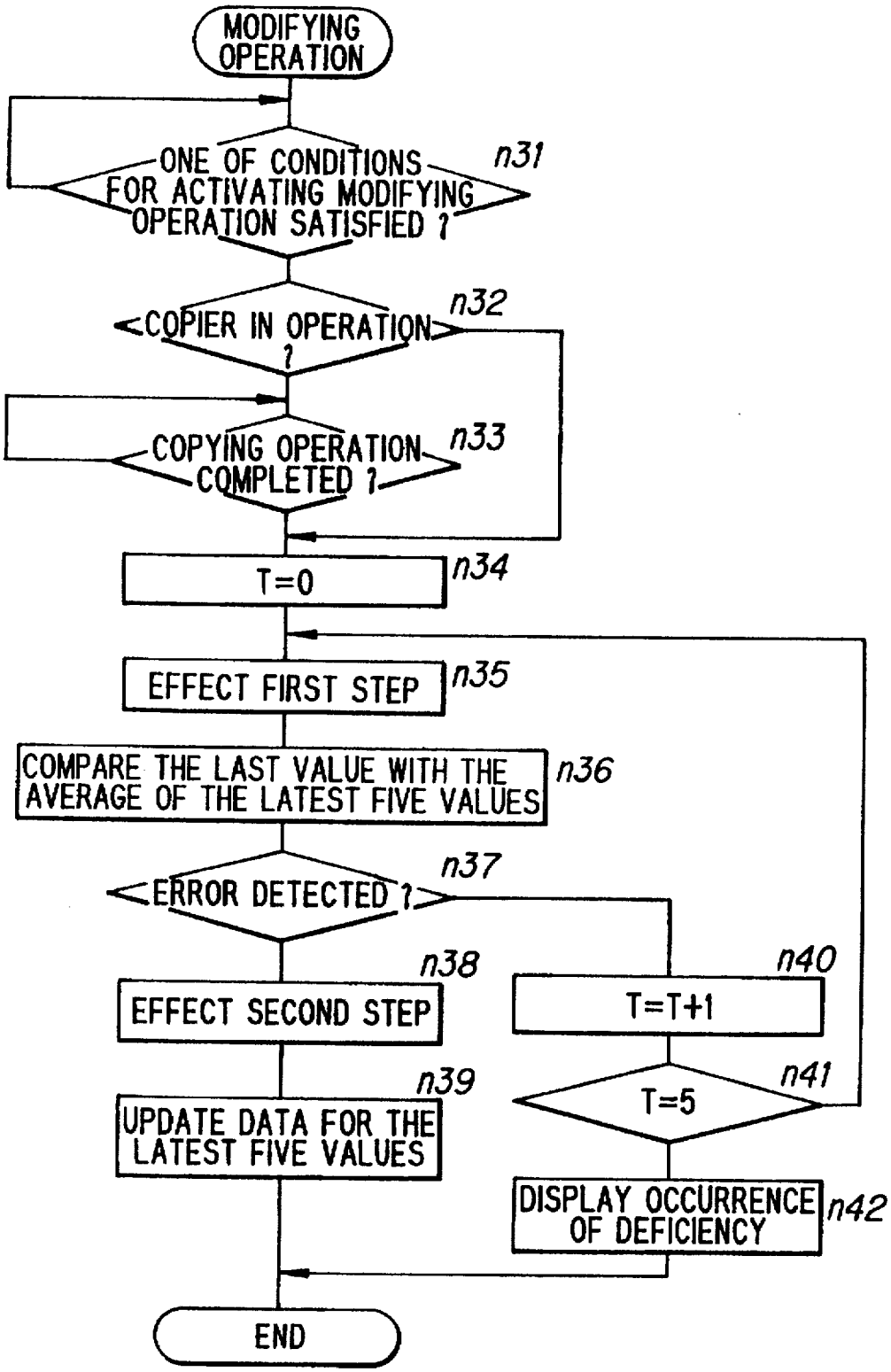
FIG. 8 is a flowchart showing a correcting process.

FIG. 8 is a flowchart showing a flow of the modifying operation. When one of the prescribed conditions for activating the modifying operation holds (n31), a judgment is made on whether the copying operation is being effected (n32). Here, the passage of the predetermined time is measured by a timer incorporated in the copier while the number of copies is counted by a counter inside the copier.

At n32, if the copier is determined to be in operation, the copying operation is kept on (n33). After the completion of this operation, the modifying operation is activated. If the copier is not in operation, the modifying operation is activated immediately. Initially, a variable T is set at 0 (n34). This variable T is used for counting the number of errors, as will be described later. Then the above-stated first step is executed (n35).

The copier has memorized the latest five values of Vae (WH) and Vae(HT) which have been obtained when the first steps were effected. The system calculates averages of the latest five values of Vae(WH) and Vae(HT), respectively and compares the averages with the currently detected values of Vae(WH) and Vae(HT) (n36). In this comparison, if at least one of the differences is greater than a predetermined value, the variable T for indicating the number of detection errors is increased by 1 (n40). For example, suppose that the predetermined value is assumed to be ±10, and if any one or both of the averages of the latest five values of Vae(WH) and Vae(HT) differs by ±10 or more from the currently detected values of Vae(WH) and Vae(HT), the operation is determined to be an error.

The above case, that is, at least one of the currently detected values differs from the average value, can be considered as an erroneous detection due to noises etc., or as that there has occurred a deficiency such as pollution of the surface of the density sample 23 or 24, the degradation of the AE sensor 22 or the degradation of the copy lamp 20. At n41, a judgment of whether T=5 is made. If T is not equal to 5, the first step is effected once again, and then the detection and judgment of error is repeated based on the comparison as effected above (n35, n36 and n37). If T=5 at n41, it is determined by the system that there occurs some deficiency and the system causes the display portion provided on the unillustrated control panel to display the fact to inform the user (n42). The user should effect the designated treatment such as cleaning of the surface of the density sample 23 and 24 and the like and activates the modifying operation again. This modifying testament can and should be activated by a predetermined key operation. If it is determined at n37 that there is no error, the second step is practiced to calculate a control characteristic (n38) and the oldest values of Vae (WH) and Vae(HT) of those memorized are deleted while the currently detected values of Vae(WH) and Vae(HT) are stored.

Thus, in this embodiment if a determination of error is made, the first step is repeated up to five times. Accordingly, it is possible to reliably distinguish whether the detection of the error is just a mis-operation or a real occurrence of deficiency. Although five times of the judgment are repeated in the above description of the embodiment, the operation should not be limited to this configuration. Four or six repetitions of the judgment may be effective. Further, the latest five sets of data are stored in the above embodiment, but this should not limit the invention. That is, storage of data may be done by the latest four or six sets. When the first step has not been operated five times in the past (when more than three times of modifying operations have not been made yet), the averages of Vae(WH) and Vae(HT) are calculated using all the data until now and the aforementioned operation is made using the thus calculated values. Specifically, if the first step has been operated only three times in the past (or when the modifying operation has been done only twice), the averages of Vae(WH) and Vae(HT) for the three past operations are compared to the current Vae (WH) and Vae(HT) detected for the modifying operation.

Thus, since the modifying operation of the control characteristic is effected, it is possible to constantly obtain satisfied duplicated images, without being affected due to the degradation of AE sensor 22 or the like. Since the modifying operation is automatically effected when one of the predetermined conditions holds, the activation of the operation does not require any labor of the user.

Figure 9:
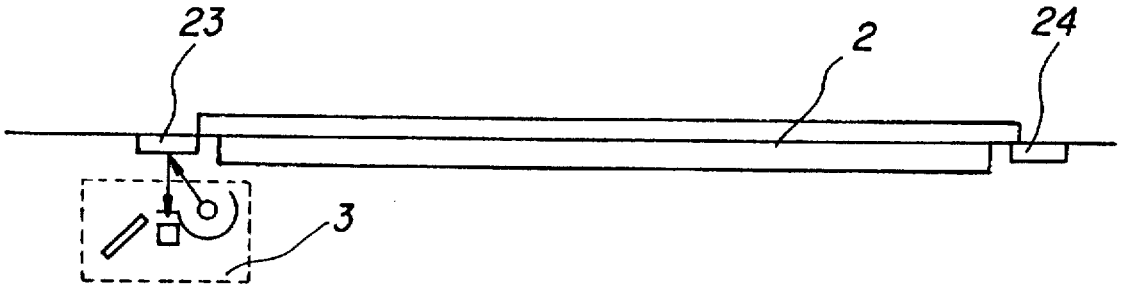
FIG. 9 is a sectional view showing essential components of a copier configuration in accordance with another embodiment of the invention.
Figure 10:
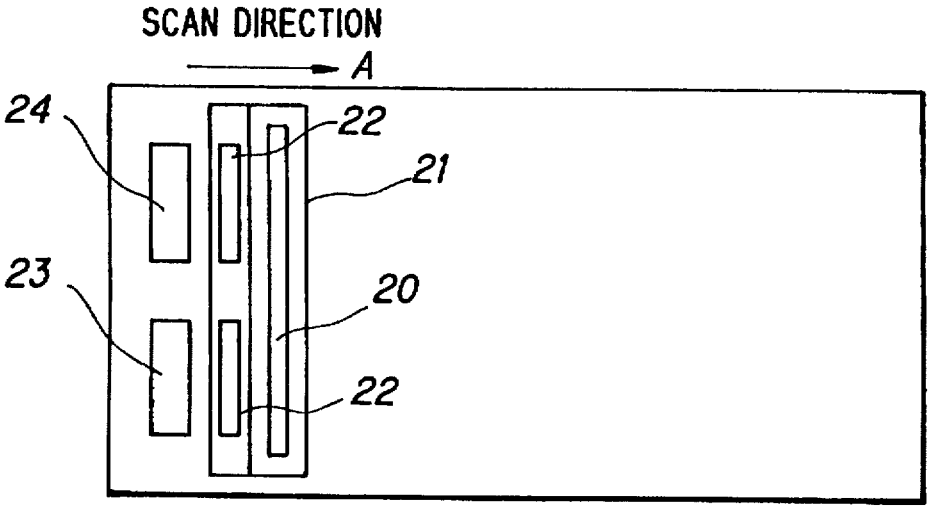
FIG. 10 is a plan view showing essential components of a copier configuration in accordance with a further embodiment of the invention.
Figure 11:
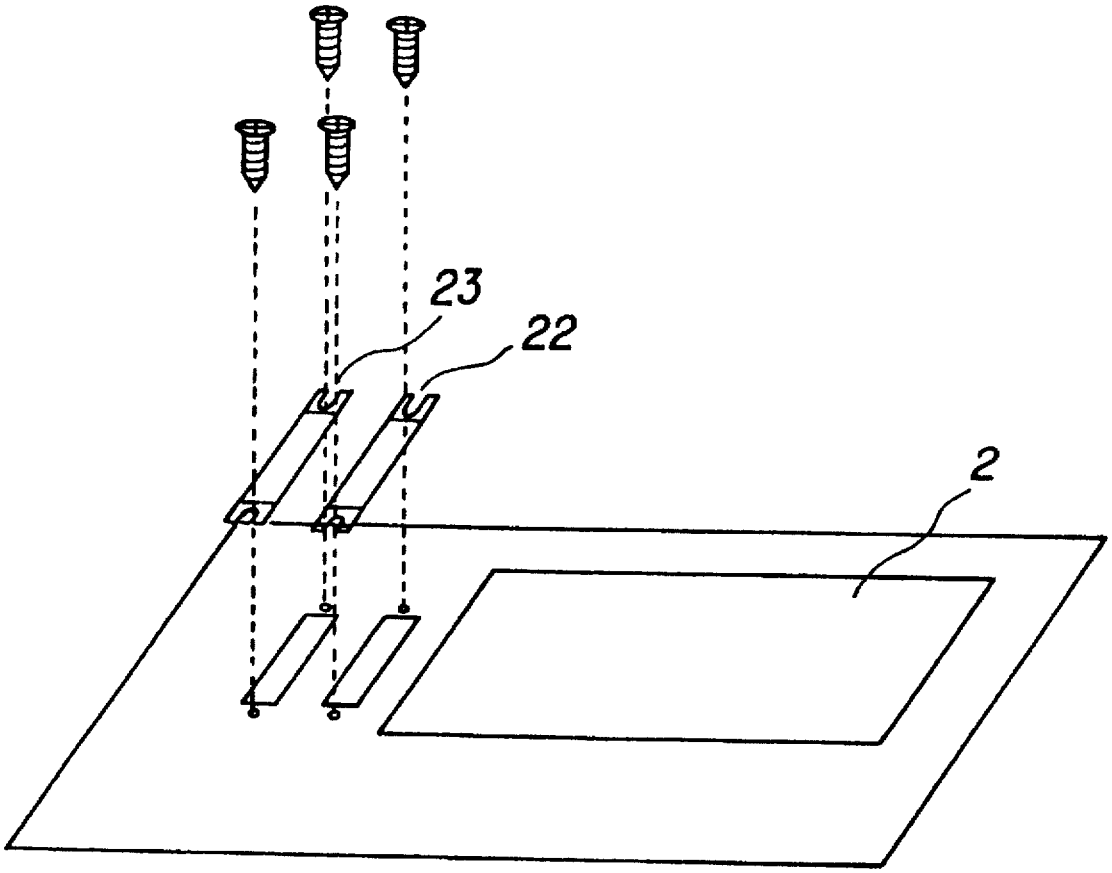
FIG. 11 is a perspective view showing essential components of a copier configuration in accordance with still another embodiment of the invention.

In the above embodiment, although the density samples 23, 24 are arranged on the home-position side of the exposure unit, the density sample 23 may be disposed on the home-position side while the density sample 24 may be provided on the opposite side (refer to FIG. 9). Here, it is also possible to provide the density sample 24 on the home-position side and the density sample 23 on the opposite side. Further, although the density samples 23 and 24 are arranged in parallel along the scan direction in that order on the home-position side, the two samples may be arranged on a line perpendicularly to the scan direction, together with a couple of AE sensors 22 (refer to FIG. 10). In this case, the first step can be done without moving the exposure unit 3. Further, during the copying operation, one of the outputs from the two AE sensors may be selected to control the applied voltage to the copy lamp 20 or the applied voltage to the copy lamp 20 may be controlled using the average of the outputs from the two AE sensors. Moreover, if the density samples 23 and 24 are adapted to be attached with screws to respective openings provided on the top face of the copier, it is possible to easily clean the density samples 23 and 24 when the surfaces of the samples are polluted (see FIG. 11).

In the description of the embodiment, the present invention was applied to the copier, but it is also possible to apply the invention to facsimiles and any other image forming apparatuses.

As has been described heretofore, in accordance with the invention, it is possible to set up a control characteristic for each image forming apparatus by a simple method. Accordingly, it is possible to set up a control characteristic suitable for the individual image forming apparatus without increasing its cost.

Since the modification of the control characteristic is made every time one of the predetermined conditions is satisfied, it is possible to constantly create stable images.

When a current reflected-light amount detected for each of the density samples is compared to the average value of the latest five reflected-light amounts detected for each of the density samples and if there is a difference by a predetermined value between the current light amount and the average of the five, the last detection is determined as to be an error. Accordingly, even if the reflected-light amount is detected erroneously, the system will not set up an inappropriate control characteristic.

What is claimed is:

1. An image forming apparatus comprising:

a plurality of density samples having different levels of density;

an exposure light source for exposing an original and said density samples to light;

a reflected-light amount detecting means for detecting amounts of light reflected from said density samples, each of which is exposed to a respective predetermined exposure amount of light;

a control-characteristic calculating means for calculating a control characteristic for determining an exposure light amount corresponding to a reflected-light amount, based on the amounts of light reflected from said density samples; and an exposure light amount controlling means for controlling the amount of light emitted from said exposure light source to the original, based on the control characteristic.

2. An image forming apparatus according to claim 1, wherein when one of previously setup conditions holds such as when a predetermined time has passed, when a predetermined number of exposures for originals have been made or when the apparatus is activated, the procedures in said reflected-light amount detecting means and said control-characteristic calculating means are effected again.

3. An image forming apparatus according to claim 1, further comprising: an average-value calculating means for calculating an average of latest several times of detection of reflected-light amount for each density sample, wherein said reflected-light amount detecting means includes an error-treatment processing means which compares a current detected value of the reflected-light amount for each density sample with the average value for the same density sample and which determines last detection to be an error if the difference between the current detected value of the reflected-light amount and the average value is greater than a predetermined value.

4. An image forming apparatus according to claim 2, further comprising: an average-value calculating means for calculating an average of latest several times of detection of reflected-light amount for each density sample, wherein said reflected-light amount detecting means includes an error-treatment processing means which compares a current detected value of the reflected-light amount for each density sample with the average value for the same density sample and which determines last detection to be an error if the difference between the current detected value of the reflected-light amount and the average value is greater than a predetermined value.

* * * * *